United States Patent [19]

Baum

[11] Patent Number: 4,784,306

[45] Date of Patent: Nov. 15, 1988

[54] HIGH-LOAD FASTENER PACKS FOR USE WITH THE MAGAZINES OF FASTENER DRIVING TOOLS

[75] Inventor: Howard L. Baum, Cincinnati, Ohio

[73] Assignee: Senco Products, Inc., Cincinnati, Ohio

[21] Appl. No.: 71,647

[22] Filed: Jul. 9, 1987

[51] Int. Cl.[4] ..... B25C 1/04

[52] U.S. Cl. ..... 227/113; 227/120; 227/130

[58] Field of Search ..... 227/109, 120, 132, 118, 227/117, 116, 113

[56] References Cited

U.S. PATENT DOCUMENTS

| | | | |
|---|---|---|---|
| 2,994,878 | 8/1961 | Abrahamsen | 227/120 X |
| 3,238,983 | 3/1966 | Abrahamsen | 227/120 X |
| 3,266,697 | 8/1966 | Fielder | 227/120 |
| 3,437,249 | 4/1969 | Baum | 227/120 |
| 3,504,840 | 4/1970 | Wandel et al. | 227/120 X |
| 4,558,811 | 12/1985 | Klaus | 227/120 X |
| 4,574,991 | 3/1986 | Thorsen, Jr. | 227/120 X |

FOREIGN PATENT DOCUMENTS

| | | | |
|---|---|---|---|
| 186914 | 7/1986 | European Pat. Off. | 227/120 |

*Primary Examiner*—Paul A. Bell
*Attorney, Agent, or Firm*—Frost & Jacobs

[57] ABSTRACT

High-load fastener packs and magazine assemblies for otherwise conventional fastener driving tools to greatly increase the magazine capacity. Each fastener pack contains a plurality of fasteners arranged in strips. The magazine is provided on one side with an opening for communication with the fastener pack. The fastener pack is readily attachable to and detachable from the magazine. A spring device within the fastener pack urges the fastener strip nearest the magazine into the guiding channel of the magazine when the adjacent portion of the magazine channel is free of fasteners. A substantially conventional pusher element on the magazine urges the fastener strips forwardly and the forwardmost fastener into the drive track of the tool guide body. Alternatively, the guide body of the tool may be provided with a conventional pulling mechanism to advance the forwardmost fastener in the magazine into the drive track. When a pulling mechanism is used, each fastener strip is provided with flexible hook-like elements. A hook-like element of tone fastener strip engages the hook-like element of the next suceeding fastener strip, advancing that fastener strip toward the drive track.

29 Claims, 8 Drawing Sheets

HIGH-LOAD FASTENER PACKS FOR USE WITH THE MAGAZINES OF FASTENER DRIVING TOOLS

TECHNICAL FIELD

The invention relates to high-load fastener packs and magazine assemblies for otherwise conventional fastener driving tools, and more particularly to packs containing a plurality of fasteners in strips and adapted to be removably attachable to modified magazines, to greatly increase the capacity of the magazines.

BACKGROUND ART

The teaching of the present invention are applicable to any appropriate fastener driving tool for fasteners of the type which can be arranged in rows, one-behind-the-other, and temporarily maintained in such rows to form strips of fasteners. Nails, staples and blind rivets are exemplary of such fasteners. While not intended to be so limited, for purposes of describing exemplary embodiments, the present invention will be set forth in its application to nail driving tools.

Prior art workers have devised numerous types of powered nail driving tools. The most common type is the pneumatically actuated nail driving tool of which the one described in U.S. Pat. No. 4,030,655 is exemplary. More recently, there has been considerable interest in electromechanical nail driving tools wherein the driver is actuated by a solenoid, one or more flywheels, or the like. U.S. Pat. No. 4,375,867 is exemplary of those patents relating to solenoid-actuated nail driving tools. U.S. Pat. Nos. 4,121,745; 4,189,080; and 4,298,072 are exemplary of those teaching flywheel-actuated nail driving tools. Finally, prior art workers have also devised self-contained internal combustion nail driving tools. Examples of such tools are taught in co-pending application Ser. No. 881,339, filed July 2, 1986 in the name of Gilbert A. Cotta, and entitled SELF-CONTAINED INTERNAL COMBUSTION FASTENER DRIVING TOOL; and in co-pending application Ser. No. 881,343, filed July 2, 1986, in the name of Gilbert A. Cotta, and entitled CAM-CONTROLLED SELF-CONTAINED INTERNAL COMBUSTION FASTENER DRIVING TOOL. The teachings of the present invention are appllicable to any of these types of tools provided with substantially conventional magazines and guide bodies.

For purposes of an exemplary showing, the present invention will be described in its application to a conventional pneumatic nail driving tool, of the general type taught in the above noted U.S. Pat. No. 4,030,655. Typically, pneumatic nail driving tools, particularly those capable of driving large nails with a single stroke of the driver, are characterized by relatively large size and considerable weight. Generally, such nailers have magazines which extend from the rearward end of the tool to the guide body at the lower forward end of the tool. The magazines are usually configured to accommodate a strip of nails constituting nails arranged in a tandem row and held in place by tape or disposable wire elements welded to each nail shank along the length of the strip. The number of nails per load is limited to the length of the magazine and in continuous or high speed operations, considerable time is consumed in replenishing the supply of nails for such a tool. As a result, prior art workers have investigated numerous ways to increase the capacity of the tool magazine without materially increasing the weight or bulk of the tool. One approach involves the use of a canister-type magazine adapted to receive a coil of nails. An example of such a tool is taught in U.S. Pat. No. 3,945,551. Another approach involves the use of a very long strip of nails housed in a separate canister remote from the tool. An example of this approach is taught in U.S. Pat. No. 3,684,339.

Yet other approaches are taught in U.S. Pat. No. 3,437,249. In this patent, one embodiment employs a longitudinal magazine having an opening in its side flanked by a pair of laterally extending support members. The support members are provided with grooves adapted to receive the heads of the forwardmost and rearwardmost nails of each of a plurality of nail strips. A first pusher means introduces the strips, one at a time, into the longitudinal magazine wherein pusher means advances each strip toward the drive track, one-after-the-other. In another embodiment, a longitudinally extending magazine, forming a guideway to the drive track, is provided with a transverse opening in which a carrier is located. The carrier, itself, is divided into a plurality of channels, each containing a nail strip. The carrier is indexable through the magazine, aligning each of its channels with the magazine guideway so that each strip of nails, in its turn, can be loaded into the magazine guideway from the carrier, as the carrier is shifted transversely of the magazine.

The present invention is based upon the discovery that a plurality of strips of nails can be prepackaged in a high-load nail pack. The pack can be removably affixed to the side of a longitudinal magazine having a guideway to the drive track and an opening in its side adjacent the nail pack. Biasing means within the nail pack will urge the strips of nails toward the magazine, with that strip adjacent the magazine entering the magazine and being urged toward the drive track by a conventional pusher means. When one strip of nails is exhausted, retraction of the pusher means will enable the next strip of nails to be located within the magazine guideway. While the nail packs of the present invention can be made to be reusable and refillable, it is preferred that they be made of plastic or cardboard material for disposal after use. In this way, the capacity of the magazine of the nail dirving tool can be greatly increased with a minimum of increase in the weight or bulk of the tool. The nail packs provide an easy and handy way to market and store strips of nails until used. The teachings of the present invention are applicable to those types of pneumatic nail driving machines which either pull the nail strips toward the drive track, or push the nail strips toward the drive track, as will be explained hereinafter.

DISCLOSURE OF THE INVENTION

According to the invention there is provided a high-load nail pack and magazine assembly for otherwise conventional nail driving tools. Each nail pack contains a plurality of nail strips in side-by-side arrangement. The magazine extends from the rearward end of the tool to the guide body at the forward end of the tool and provides a channel or guideway for the nail strips to the drive track within the tool guide body. The magazine, on one side, is provided with an opening adapted to cooperate with the nail pack. In one embodiment, the opening is adapted to receive a portion of the nail pack, which is inserted therein. In another embodiment, the nail pack engages a pair of slots extending along the magazine and slides along the magazine until it is positioned opposite the opening therein. In either embodiment, the nail pack is readily attachable to and detachable from the magazine.

Biasing means are provided within the nail pack to urge that nail strip nearest the magazine into the magazine guideway when the adjacent portion of the magazine guideway is free of nails.

In one embodiment of the invention, the magazine is provided with a substantially conventional pusher element which urges the nail strips toward the guide body and the forwardmost nail thereof into the drive track. In another embodiment, the nail driving tool is provided with nail advancing means, known per se, in association with the guide body and capable of pulling the nail strips toward the guide body and shifting the forwardmost nail thereof into the drive track. When the nail driving tool is provided with a pulling mechanism in association with the guide body, each nail strip is provided with flexible hook elements adapted to engage and advance the next succeeding nail strip.

DETAILED DESCRIPTION OF THE INVENTION

Figure 1:
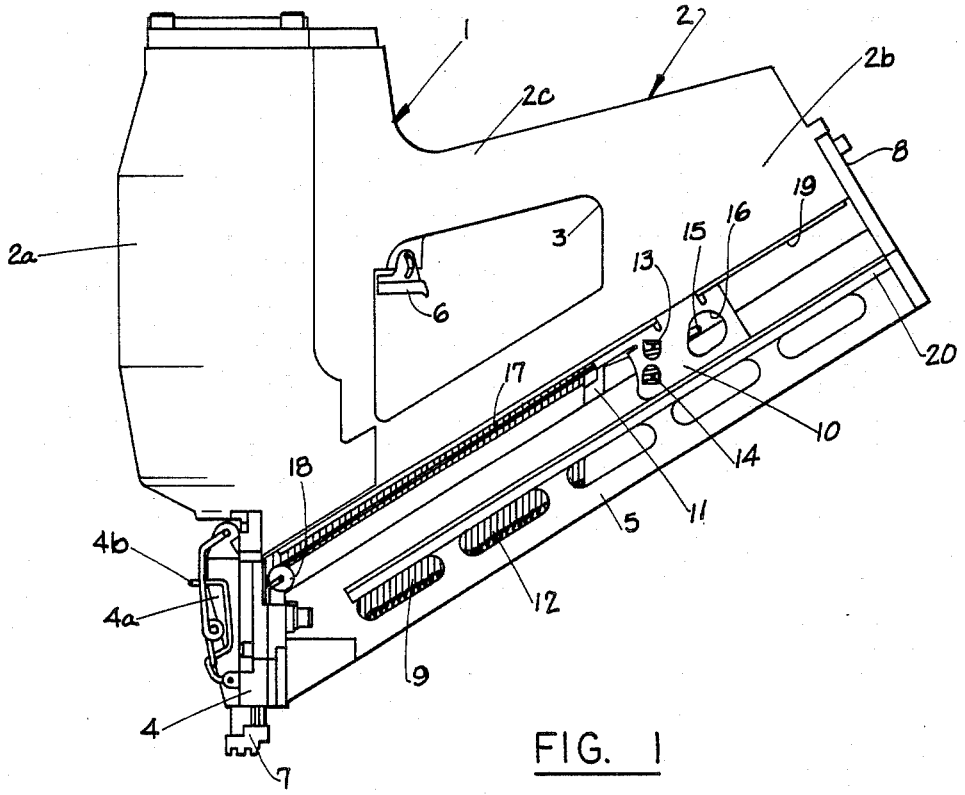
FIG. 1 is a side elevational view of an exemplary prior art pneumatic nail driving tool to which the teachings of the present invention may be applied.

Reference is first made to FIG. 1 wherein an exemplary pneumatic nail driving tool, of the type taught in the above mentioned U.S. Pat. No. 4,030,655, is shown. The tool, generally indicated at 1, comprises a body generally indicated at 2. The body 2, in turn, comprises a main forward portion *2a* and a rearward portion *2b*. The rearward portion has an opening 3 formed therein, defining a handle portion *2c*. The lower end of the forward portion *2a* is provided with a guide body 4. A magazine 5 extends along the length of the bottom of the tool body 2, from the rearward end thereof to the guide body 4.

The body 2 is generally hollow, and the upper rearward end is provided with an opening (not shown) for attachment by means of a flexible hose to a source of air under pressure. The forward or main body portion *2a* contains a cylinder having a piston attached to a driver. The upper end of the cylinder is closed by a main valve which, when open, admits air under pressure into the cylinder, driving the piston and driver downwardly through the guide body, to drive the forwardmost nail from the magazine into a workpiece. The main valve, itself, is controlled by a remote valve, which is actuated by manual trigger 6. The tool 1 is provided with a workpiece responsive trip 7 which, when in its normal unactuated position, disables the manual trigger 6. On the other hand, when the workpiece responsive trip 7 is pressed against the workpiece to be nailed, it enables the manual trigger 6 so that the tool can be actuated. Thus, the workpiece responsive trip constitutes a safety device which must be pressed against the workpiece before the tool will operate.

The guide body 4 forms a drive track for the tool driver. The guide body may be provided with a front gate 4a and an associated latch mechanism **4*b*** for access to the drive track, should the tool for any reason become jammed.

The magazine 5 is affixed at its forward end to the guide body 4. At its rearward end, the magazine 5 is supported by a plate 8 which is also affixed to the rear end of the tool body 2. The magazine comprises an elongated member of generally U-shaped cross-section, defining a guideway or channel for the strip of nails 9. The magazine channel leads to an opening in the rearward face of guide body 4, which, in turn, leads to the drive track. The magazine is provided with a pusher element 10 slidably mounted thereon. The pusher element carries a spring biased feeder shoe member 11 adapted to engage the rearwardmost nail of the strip to urge the strip forwardly toward the guide body and to locate the forwardmost nail of the strip within the drive track. A strip of nails is illustrated in FIG. 1 at 9. The feeder shoe member 11 is hingedly affixed to pusher element 10 as at 13 and 14. The feeder shoe member 11 has at its rearward end an extension or lever 15 accessible through an opening 16 in pusher element 10. By depressing the lever 15 it is possible to swing the feeder shoe member 11 out of engagement with the strip of nails during a nail unloading operation. The nail strip can be loaded into magazine 5 or removed from magazine 5 through an appropriate port (not shown) in rear plate 8.

Pusher element 10 is constantly urged forwardly by a strip-type coil spring 17 which seeks to coil itself about a spool element 18 affixed to the rearward surface of guide body 4. When the strip of nails 9 is exhausted, a new strip may be inserted through the port in plate 8 and shifted toward guide body 4. The pusher element 10 is shifted rearwardly past the strip of nails to such a position wherein the feeder shoe member 11 can engage the rearwardmost nail of the strip. As the pusher element 10 is shifted rearwardly, the feeder shoe member 11 will swing out of the way, riding along the strip of nails until its spring biasing causes it to shift behind the last nail of the strip. At this point, the tool is reloaded and ready for use. The upper portion of pusher element 10 slidably engages about a rail 19 bolted or otherwise appropriately affixed to the tool body 2 and extending substantially the length of magazine 5. The lower portion of pusher element 10 rides a slot 20*a* formed by an elongated flange 20 constituting an integral part of magazine 5 and again extending the majority of the length thereof.

It will be appreciated from the above brief description that the number of nails with which the tool 1 can be loaded is limited by the length of magazine 5. It can therefore be appreciated that it would be advantageous to increase the capacity of magazine 5 without significantly adding to the weight or bulk of tool 1.

Figure 2:
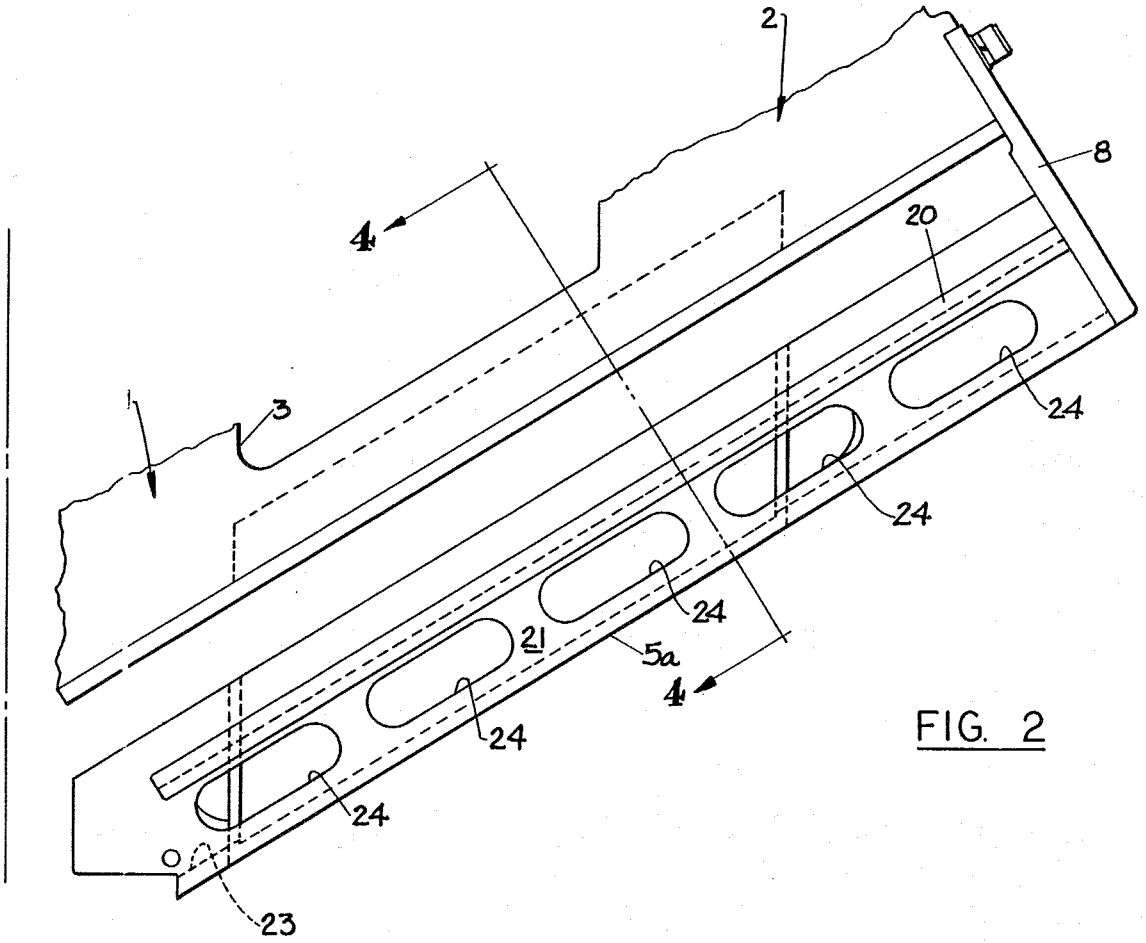
FIG. 2 is a fragmentary left side elevational view of the magazine of the tool of FIG. 1, modified in accordance with the teachings of the present invention.
Figure 3:
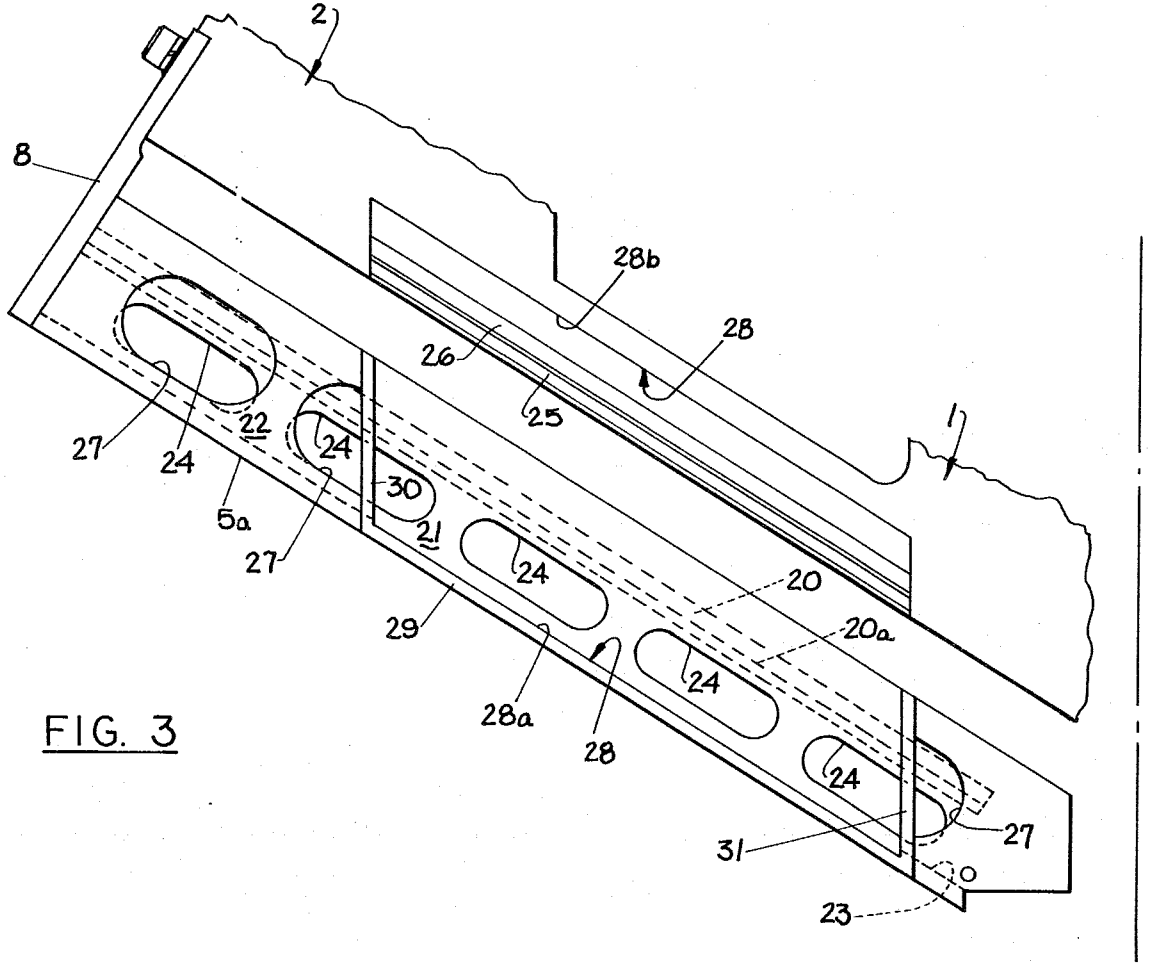
FIG. 3 is a fragmentary right side elevational view of the magazine of FIG. 2.
Figure 4:
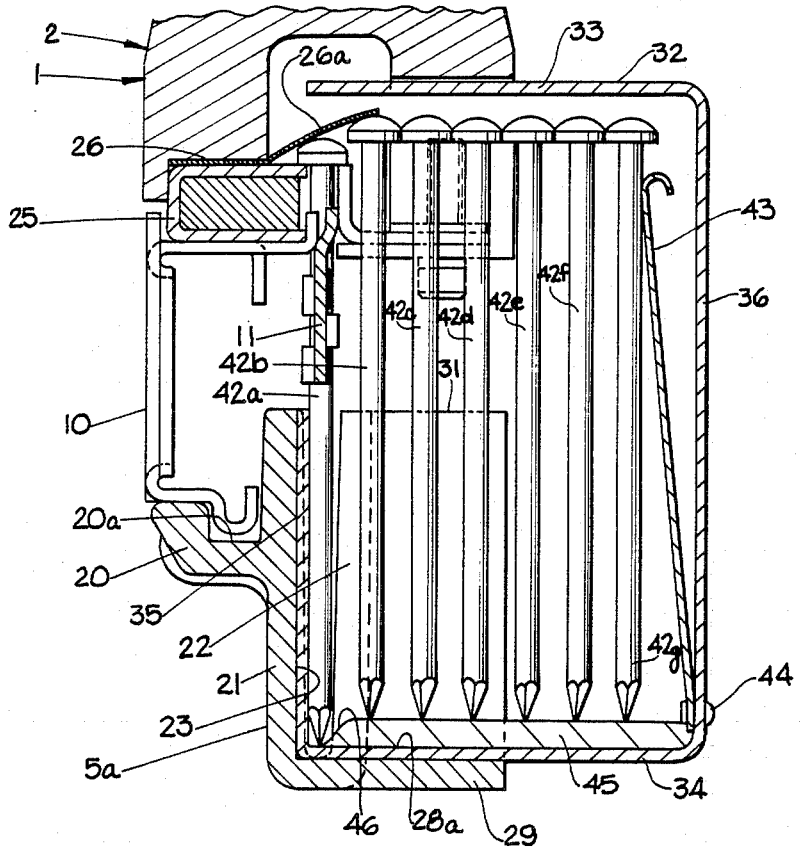
FIG. 4 is a fragmentary cross-sectional view taken along section line 4—4 of FIG. 2 and illustrating a nail pack mounted on the magazine.

Reference is now made to FIGS. 2 and 3. FIGS. 2 and 3 illustrate, respectively, the left and right side of a magazine similar to magazine 5 of FIG. 1 and modified in accordance with the teachings of the present invention. It will be understood that the magazine of FIGS. 2 and 3 is intended to be affixed to a tool substantially otherwise identical to tool 1 of FIG. 1, and where applicable, like parts have been given like index numerals. Reference is additionally made to FIG. 4 which is a cross-sectional view taken along section line 4—4 of FIG. 2. The magazine of FIGS. 2, 3 and 4 is designated by index numeral 5*a* and comprises an elongated member of U-shaped cross-section having a left wall 21 and a right wall 22 defining a nail strip receiving guideway or channel 23. The magazine 5*a* is affixed to plate 8 by any appropriate means such as welding or the like, or may constitute an integral one-piece part thereof. As is most clearly shown in FIG. 2, the left side 21 of magazine 5*a* is provided with a series of elongated ports 24 so that a nail strip 9 located therein is visible. The left side 21 of magazine 5*a* is provided with elongated flange 20, as in FIG. 1, providing the slot or groove 20*a* in which the lower portion of pusher element 10 rides.

As can be seen in FIGS. 3 and 4, the upper rail 19 of FIG. 1 has been replaced by a magnetic rail 25 and a shim element 26 to be described in greater detail hereinafter. The magnetic rail 25 and shim element 26 are affixed to the body 2 of tool 1 by machine screws, bolts or the like (not shown). Again, as is evident from FIG. 4, the upper portion of pusher element 10 slidably engages the magnetic rail 25.

The right side 22 of magazine 5*a* is similar to the right side (not shown) of the magazine 5 of FIG. 1. The right side 22 of magazine 5*a* is provided with a series of ports 27. The primary difference between magazine 5*a* and magazine 5 of FIG. 1 lies in the fact that a relatively large opening 28 of parallelogram configuration is formed in the right side 22 of magazine 5*a* and the right side of the tool body 2 (see FIG. 3). That part of the opening 28 formed in the right side 22 of magazine 5*a* is indicated by index numeral 28*a*. That part of opening 28 formed in the tool body 2 is indicated by index numeral 28*b*. The opening 28 is of parallelogram configuration so that its ends will be substantially vertical with respect to the workpiece when the tool 1 is in the position illustrated in FIG. 1. That portion of opening 28 formed in the right side 22 of magazine 5*a* is surrounded by a bottom wall 29 and end walls 30 and 31 which form a sort of laterally extending trough.

Figures 5, 6, 7, 8, 9:
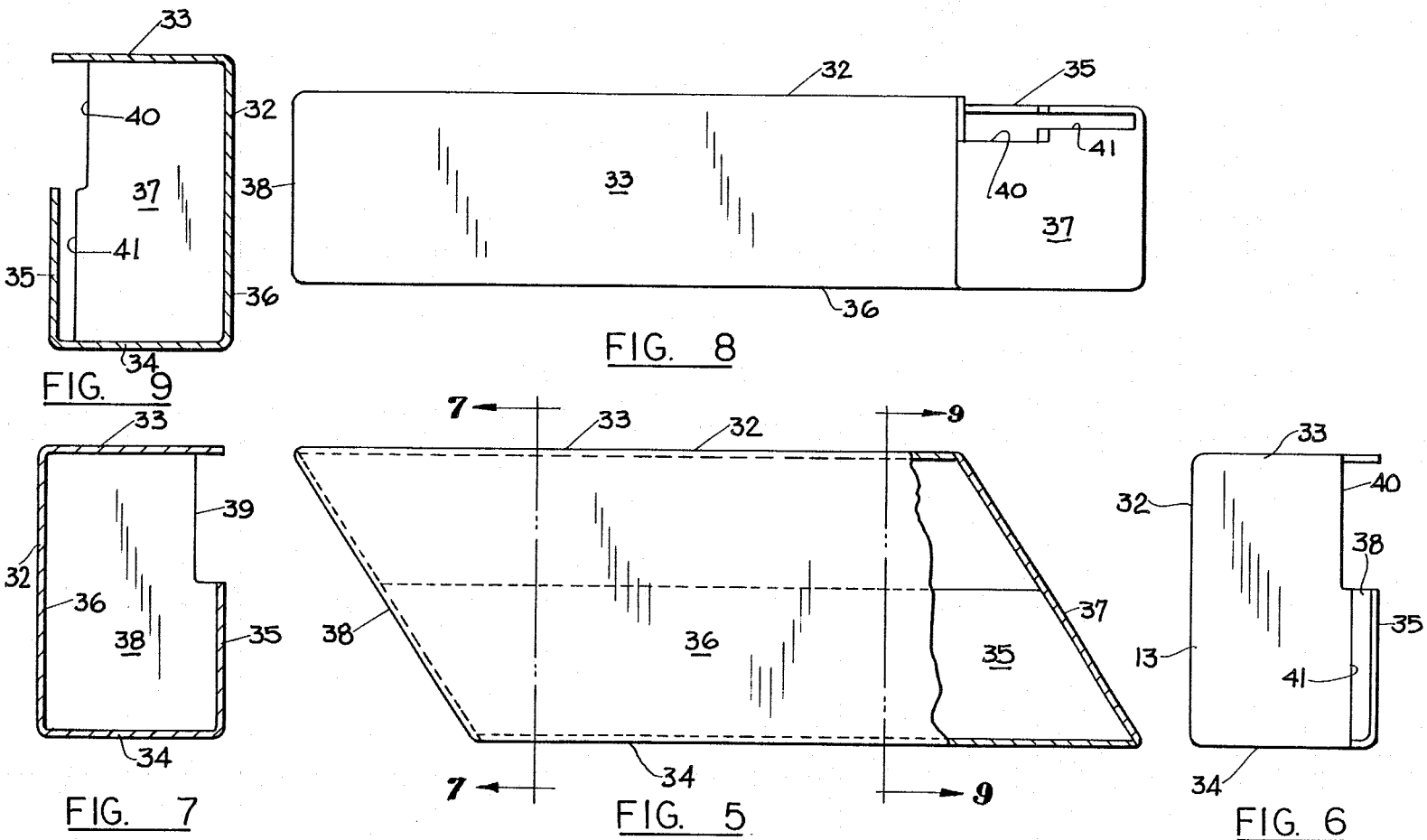
FIG. 5 is a side elevational view of the nail pack of FIG. 4.
FIG. 6 is an end elevational view of the nail pack of FIG. 5 as seen from the right thereof.
FIG. 7 is a cross-sectional view taken along section line 7—7 of FIG. 5.
FIG. 8 is a plan view of the nail pack of FIG. 5.
FIG. 9 is a cross-sectional view taken along section line 9—9 of FIG. 5.

The opening 28 with its parts 28*a* and 28*b*, and the trough-like structure 29-30-31 are intended to receive a nail pack 32, as shown in FIG. 4. The nail pack 32 is illustrated by itself in FIGS. 5–9. Nail pack 32 comprises a box-like structure having a top 33, a bottom 34, side walls 35 and 36, a forward end 37 and a rearward end 38. As is most clear from FIG. 5, the nail pack 32 is of parallelogram configuration, the top 33 and the bottom 34 being parallel and the ends 37 and 38 being parallel. It will be noted that the forward end 37 and the rearward end 38 slope upwardly and rearwardly, as viewed in FIGS. 5 and 8. The rearward end 38 has a notch 39 formed therein (see FIG. 7) to provide clearance for pusher element member 11. The forward end 37 (see FIGS. 6, 8 and 9) has a similar notch 40 formed therein for the same purpose. The notch 40, however, has an extended portion 41 terminating at the nail pack bottom 34. The notches 40 and 41 and front wall 37 constitute an opening through which nail strips contained within the nail pack 32 pass, one-by-one, from the nail pack to the guideway or channel 23 of magazine 5*a*. It will be noted that side wall 35 extends upwardly from the nail pack bottom 34 to the notch 40 in front wall 37 and the notch 39 in rear wall 38, again providing clearance for the pusher element member 11.

The nail pack 32 can be made of any appropriate material, including metal, plastic, cardboard, or the like. While the nail pack can be reusable and refillable, it lends itself well to being disposable. Plastic, cardboard or the like constitute preferred materials from which nail pack 32 is made since they are inexpensive materials and will add little weight to the tool 1 when the nail pack is affixed thereto. It will be understood by one skilled in the art that the nail pack may have an appropriate removable overwrap or the like to prevent loss of nails therefrom during shipment and storage.

The embodiment of FIGS. 1–9 having been described in detail, its operation can now be set forth. Assuming that the tool 1 is empty of nails and the pusher element 10 is in its forwardmost position, it is only necessary for the operator to obtain a nail pack and remove therefrom its outer wrapping. The nail pack is then inserted (side 32 foremost) into the opening 28 in magazine 5*a* and tool body 2. The nail pack is just nicely received within the opening and within the trough 29-30-31. Appropriate latch means (not shown) may be provided to releasably maintain the nail pack in the position shown in FIG. 4. When in this position, it will be noted that the slot 41 in the forward end 37 of nail pack 32 aligns with the guideway or channel 23 of magazine 5*a*.

In FIG. 4, for purposes of an exemplary showing, nail pack 32 is illustrated as containing seven strips of nails 42*a* through 42*g*. The width of nail pack 32 and the number of nail strips located therein can be varied and does not constitute a limitation on the present invention. Each of the nail strips can be of the type described with respect to nail strip 9 of FIG. 1. In an exemplary and well known nail strip, the nails of each strip are held together by tape. The nail heads are staggered vertically and each nail head is provided with a notch to receive the shank of the next succeeding nail.

Nail pack 32 is preferably provided with means to bias the strips of nails toward nail pack side 35. The biasing means can take any appropriate form including a simple expandable means or the like. For purposes of an exemplary showing, pack 32 is illustrated in FIG. 4 as being provided with a biasing spring plate 43, having a body portion 43*a* affixed along wall 36 near bottom 34, as at 44. Spring plate 43 extends substantially the length of nail pack 32 and has a free edge portion 43*b* which urges the upper portion of the adjacent strips of nails toward the left as viewed in FIG. 4.

It would be possible to provide a second spring plate as shown in broken lines in FIG. 4 at 43*c*, having a body portion 43*d* and a free edge 43*e*. In such an instance, the body portions 43*a* of spring plate 43 and 43*d* of spring plate 43*e* can have wide slots formed therein (not shown) so that body portions 43*a* and 43*d* each comprise a plurality of finger-like elements which can be interdigitated. It will be noted that spring plate 43*c* is affixed to wall 36 near its top. The free edge 43*e* of spring plate 43*c* engages the lower portion of the adjacent strip of nails. It would also be possible to simply substitute the spring plate 43*c* for spring plate 43.

It is desirable that that strip of nails 42*a*, nearest nail pack wall 35 and aligned with guideway or channel 23 of magazine 5*a* be slightly lower than the remainder of the nail strips. It will be understood that since all of the nail strips are constantly urged to the left as viewed in FIG. 4, they will be in contact with each other. Head-to-head contact between nail strip 42*a* and 42*b* would create greater friction against shifting of nail strip 42*a* toward the tool drive track than if the heads of nail strip 42*a* ride against the shanks of nail strip 42*b*. To better show the mechanism, nails strips 42*a* and 42*b* are shown slightly separated in FIG. 4. Normally, the heads of the nails of strip 42*a* would be contacting the shanks of the nails of strip 42*b*.

To maintain nail strips 42*b* through 42*g* slightly highter than nail strip 42*a*, the nail pack 32 may have a simple insert 45 affixed to the inside surface of nail pack bottom 34. Insert 45 extends to the left to a position short of nail pack wall 35 and is sloped as at 46 to enable each nail strip, in its turn, to achieve the lower position in which nail strip 42*a* is illustrated. It will be understood that the insert 45 could constitute an integral part of nail pack 32, or the bototm wall 34 of nail pack 32 could be so configured or molded as to provide the equivalent of insert 45.

The presence of magnetic rail 25 assures that nail strip 42*a* is properly aligned with respect to the guideway or channel 23 of magazine 5*a*. As shown, nail strip 42*a* contacts the magnetic rail 25 when in its proper horizontal position. To assure its proper vertical position, as defined by contact of the nail heads of strip 42*a* against the upper surface of magnetic rail 25, the shim element 26 has an arcuate extension 26*a* which tends to cam nail strip 42*a* into its proper vertical position. That portion of the tool body 2 ahead of opening 28 carries an additional plate 47 which has an upturned end portion 48 coplanar with the top surface of magnetic rail 25 and serving as a support for the other side of the nail heads of strip 42*a* as they travel toward guide body 4 and the drive track therein. Because of magnetic rail 25, pusher 10 and feeder shoe member 11 should be made of non-magnetic material.

When nail strip 42*a* has been depleted, the next nail strip 42*b* will assume its position under the urging of biasing element 43, shim portion 26*a* and ramp 46. It is only necessary for the operator to pull pusher element 10 back to its retracted position. The spring biased pivoted member 11 of pusher element 10 will shift out of the way to pass by the nail strip and then will snap into position to engage the rearmost nail of the nail strip to advance it toward guide body 4. This procedure is repeated until all of the nail strips 42*a* through 42*g* are depleted. At this point, the nail pack 32 is removed from tool 1 and a new nail pack is inserted in its place. If disposable, the original nail pack 32 is discarded. If not disposable, it can be refilled.

While the nail pack and magazine assembly of the present invention have thus far been described in terms of containing strips of headed nails, it will be understood that strips of headless nails would function in the same manner. With minor dimensional changes and the like, the nail pack 32 could contain staples, blind rivets, or other appropriate sticks or strips of fastener means.

Figure 14:
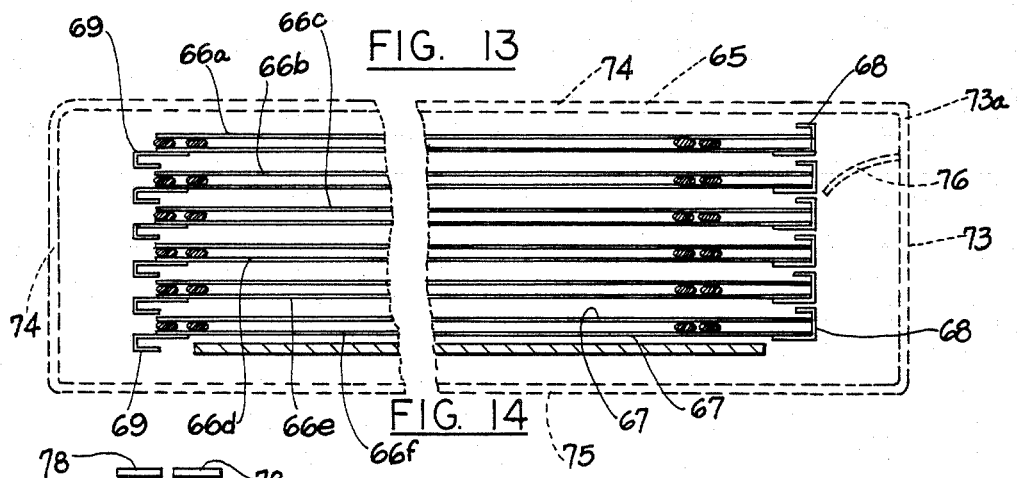
FIG. 14 is a fragmentary cross-sectional view, taken along section line 14—14 of FIG. 13.

The tool 1 of FIG. 1 is shown as being of the type wherein the magazine 5 lies at an angle to the workpiece. Tools have been developed and are well known wherein the magazine is not so angled, but rather is substantially parallel to the workpiece when the tool is used. It will be understood that the teachings of the present invention could be equally well applied to such a tool. In such an instance, the opening 28 in the magazine 5*a* and the body 2 would be rectangular in configuration, rather than a parallelogram, as would be the pack 32. Furthermore, in such an instance the heads of the nails of the nail strip would not be vertically overlapped. Similarly, in the tool of FIG. 1, the opening 28 and the pack 32 could be of rectangular configuration, rather than that of a parallelogram. In such an instance, however, the nails of the nail strips within the pack would lie at an angle as illustrated in the embodiment of FIG. 14, to be described hereinafter.

Figure 10:
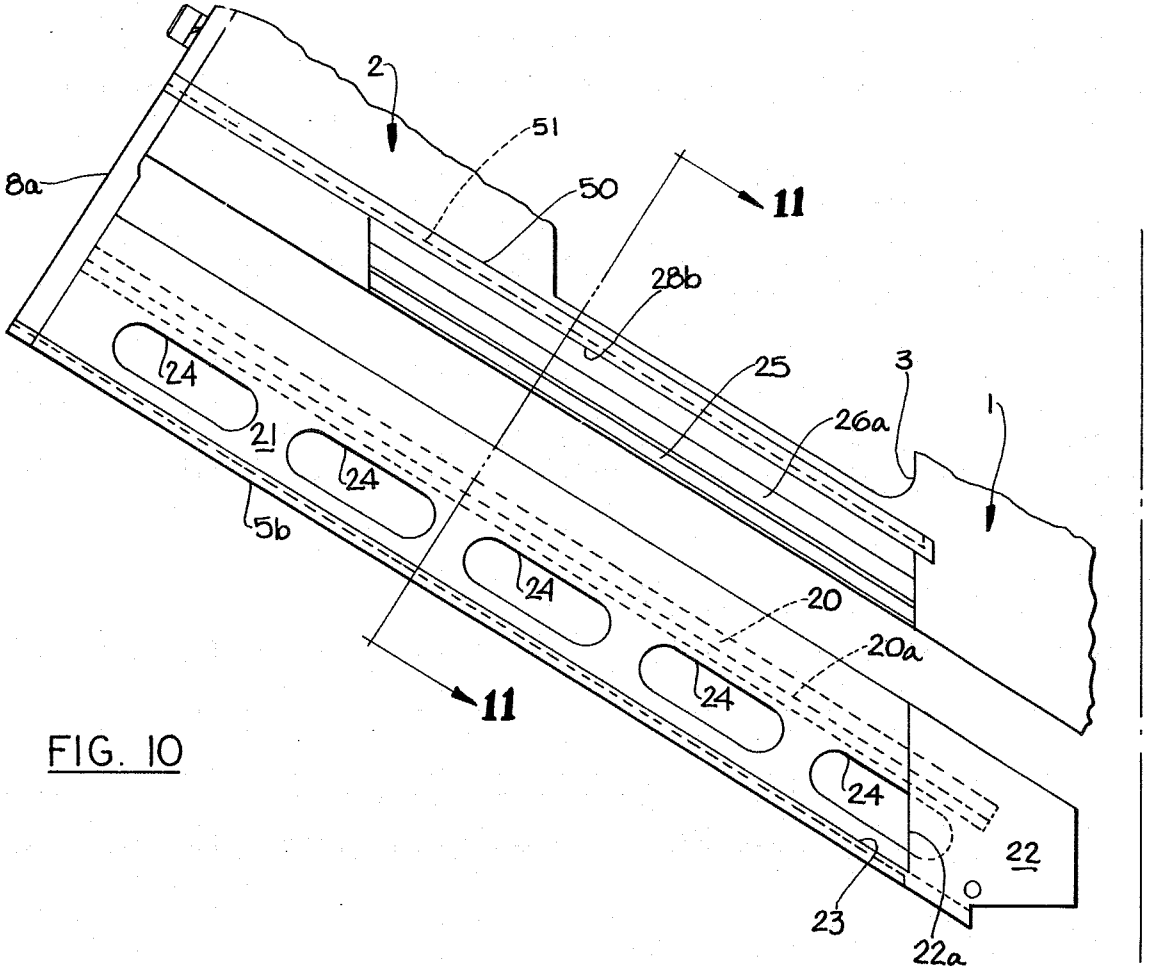
FIG. 10 is a fragmentary right side elevational view of a magazine, similar to FIG. 3, but constituting the magazine of another embodiment of the present invention.
Figure 11:
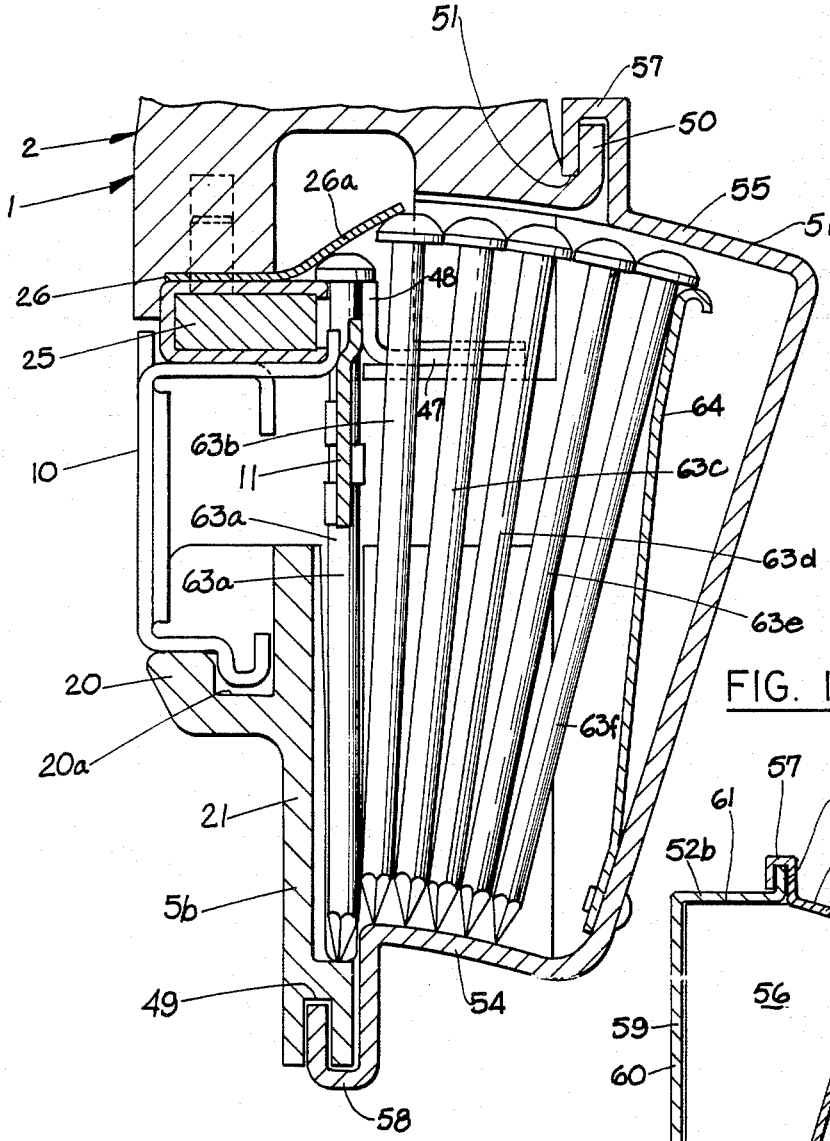
FIG. 11 is a fragmentary cross-sectional view taken along section line 11—11 of FIG. 10 and illustrating another embodiment of nail pack affixed to the magazine.
Figure 12:
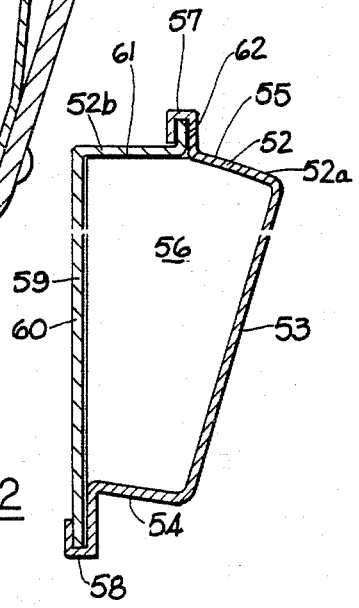
FIG. 12 is a transverse cross-sectional view through the nail pack of FIG. 11, illustrating the closure member therefor.

Reference is now made ot FIGS. 10, 11 and 12, wherein another embodiment of the present invention is illustrated. Again, the embodiment is intended for use with a tool of the type illustrated in FIG. 1. Furthermore, the magazine indicated at 5*b*, is in many respects similar to magazines 5 and 5*a*. As a consequence of this, where applicable, like parts have been given like index numerals.

The left side 21 of magazine 5*b* is substantially identical to the left side 21 of magazine 5*a* and to this end is provided with an elongated flange 20 defining a slot 20*a* in which the lower portion of pusher element 10 slidably rides. The left side of body 2 is again substantially identical to that shown in FIG. 4, and is provided with magnetic rail 25 and shim 26, having arcuate portion 26*a*. The upper portion of pusher element 10 engages and rides on magnetic rail 25.

The right hand side 22 of magazine 5*b* terminates at edge 22*a* which is equivalent to the inside surface of wall or trough portion 31 of FIG. 3. The remainder of the magazine 5*b* does not have a right side. The plate 8*a*, equivalent to plate 8 of FIG. 3, differs from plate 8 in that the surface facing the viewer in FIG. 10 corresponds to the adjacent surface of magazine 5*b*, i.e., the inner surface of magazine wall 21. The only other difference between magazine 5*b* and magazine 5*a* is perhaps most clearly seen in FIG. 11. The lower edge of magazine 5*b* is provided with a central, longitudinal slot 49.

The right hand side of body 2 is provided with an opening 28*b* identical to the opening 28*b* of FIG. 3. Above opening 28*b* the body 2 has an integral longitudinal flange 50 which extends from the rearward end of body 2 to a position just slightly beyond the forward edge of opening 28*b*. The flange 50 defines a longitudinal slot 51, the purpose of which will be apparent hereinafter.

FIG. 11 illustrates the magazine 5*b* provided with a nail pack 52 of this embodiment. The nail pack, itself, is illustrated in FIG. 12. Nail pack 52 comprises a container portion 52*a* and a cover portion 52*b*. The container portion comprises a side wall 53, a bottom wall 54, a top wall 55, and two substantially identical end walls, the forward one of which is shown at 56. It will be understood that in side elevation the pack 52 may have the configuration of a parallelogram, the forward wall 56 and the rearward wall (not shown) being parallel and sloping upwardly and rearwardly in a fashion similar to forward and rearward walls 37 and 38 of FIG. 5. The top 55 extends to about the center of the upper edge of the forward wall 56 and the rearward wall (not shown) and terminates in an upstanding hook-shaped element 57. The bottom 54 of container portion 52*a* terminates in a downwardly depending hook-shaped element 58. The cover portion 59 has a first part 60 which constitutes the other side wall of pack 52. The bottom edge of part 60 is slidably engaged in the hook-shaped portion 58 of container portion 52*a*. Cover portion 52*b* has a second part 61 constituting the rest of the top of pack 52 and terminating in an upstanding flange 62 slidably engagable in hook-shaped element 57 of container portion 52*a*. With the cover portion 52*b* in place, as illustrated in FIG. 12, nail strips (not shown) contained within pack 52 are fully enclosed. Again, the pack 52 may be provided with an overwrap, or the like (not shown), maintaining cover portion 52*b* in position on container portion 52*a* during transport and storage.

The embodiment of FIGS. 10 and 11 having been described in detail, its operation is as follows. Assuming that the tool 1 is empty of nails, packs 52 is freed of its overwrap or the like and is caused to approach tool 1 from the rear, with the hook-shaped portion 57 of pack 52 aligned with slot 51 of tool body 2 and the hook-shaped portion 58 aligned with slot 49 of magazine 5*b*. Forward movement of pack 52 is continued to cause hook-shaped pack element 57 to engage tool body slot 51 and to cause hook-shaped pack element 58 to engage in magazine slot 49. These engagements are sliding engagements and continued forward movement of pack container portion 52*a* along the side of tool 1 will displace pack cover portion 52*b*. Once the rearward end of pack container portion 52*a* clears tool plate 8*a*, the pack cover portion 52*b* will fall away and can be appropriately disposed of.

Again it will be understood that pack elements 52*a* and 52*b* can be made of any appropriate material including metal, cardboard, plastic, or the like. The pack 52 lends itself well to being disposable in nature, and when this is the case, it is preferred that it be made of cardboard, plastic, or the like. It is within the scope of the invention to make pack 52 refillable, if desired.

The pack container portion 52*a* is shoved forwardly along the tool body 2 and magazine 5*b* until it is stopped by the forward ends of slots 51 and 49. At this point, the pack container portion 52*a* is in its proper position. Any appropriate form of releasable latch means (not shown) may be provided to releasably maintain pack container portion 52*a* in its proper position.

For purposes of an exemplary showing, the pack 52 of FIG. 11 is illustrated as containing six nail strips 63*a* through 63*f*. The pack 52 can be appropriately dimensioned to contain a greater or lesser number of strips, as desired. Again, pack 52 is provided with a biasing means to urge the adjacent nail strip 63*a* into abutment with magnetic rail 25 and into alignment with the channel or guideway 25 of magazine 5*b*. The biasing means may be of any appropriate type. To this end, biasing means 64 is shown, substantially identical to biasing means 43 of FIG. 4. The other spring arrangements described with respect to FIG. 4 could be applied to the embodiment of FIG. 11.

Once in place, the operation of the magazine and nail pack assembly of FIG. 11 is otherwise identical to that described with respect to the embodiment of FIG. 4. When the pack 52 has been emptied, it is shifted rearwardly along tool 1 until released therefrom, and a new pack may be applied to the tool in the manner described above.

While nail pack 52 has been described as being of parallelogram shape in side elevation, it can be of rectangular configuration, for use with a tool the magazine of which is horizontal to the workpiece when in position to fire. The nail pack 52 may also be of rectangular configuration for use with the tool of FIGS. 1 and 10. This would necessitate, however, modification of the size and position of opening 28*b* and magazine edge 22*a*, as well as the length of flange 50 and its slot 51. This would further necessitate arrangement of the nail strips within pack 52 in a manner similar to that illustrated in FIG. 14.

Finally, as in the case of nail pack 32 of FIG. 4, nail pack 52 could contain headless nails or other appropriate fastening means such as sticks of staples, strips of blind rivets, or the like.

Figure 13:
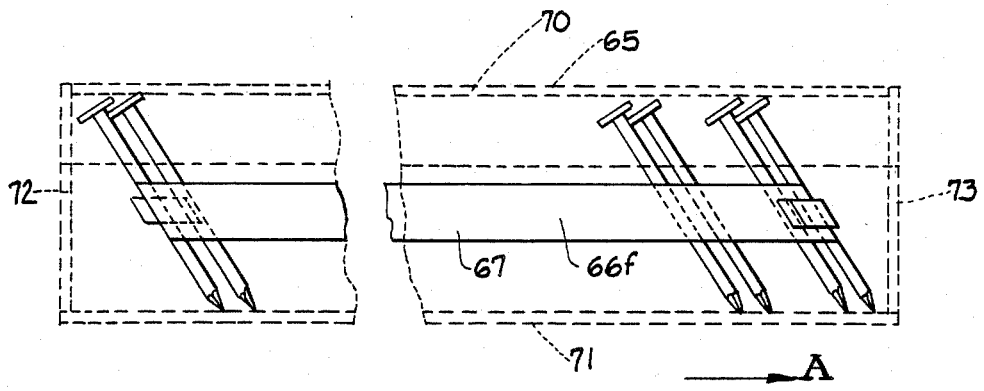
FIG. 13 is a fragmentary side elevational view of another embodiment of nail pack for use with a nail driving tool of the type which has a nail feed mechanism in association with its guide body.

As indicated above, there are those fastener driving tools which, instead of using a feeder shoe, have means in association with the guide body to pull the strip of fasteners into the drive track. Again, this is exemplified by the above noted U.S. Pat. No. 3,945,551. The teachings of the present invention are applicable to such tools as well. This is illustrated, for example, in FIGS. 13 and 14. FIGS. 13 and 14 are respectively a side elevational view and a plan view of a nail pack 65 containing a plurality of nail strips 66*a* through 66*f*. The nail pack 65 is diagrammatically indicated in broken lines. The pack 65 may be of the type described with respect to FIG. 4 or of the type described with respect to FIG. 11. For purposes of an exemplary showing it is illustrated as being of the type described with respect to FIG. 4. For purposes of an exemplary showing only, the nail pack 65 is illustrated as being rectangular in side elevation with the nails of each strip being oriented at an angle to the vertical. Depending upon the nature of the tool being used, the nails could be oriented vertically as viewed in FIGS. 13 and 14, as will be understood by one skilled in the art.

The nails of each strip may be joined together by any appropriate and well known means. For purposes of an exemplary showing, they are illustrated as being joined together by pairs of tape elements 67.

In this instance, each nail strip is identical and each is provided with a forward hook-like element 68 and an oppositely oriented rearward hook-like element 69. These hook-shaped elements may be bonded to the tape or otherwise appropriately affixed thereto and may be made of flexible paper, plastic, or the like. Where the nails are angled as in FIGS. 13 and 14, the hook-shaped elements may be correspondingly angled, as shown in FIG. 13.

Nail pack 65 is shown as having a top wall 70, a bottom wall 71, a rearward end 72, a forward end 73 and side walls 74 and 75. Side wall 74 extends only part way up toward top 70, as is the case of side wall 35 of nail pack 32. It will be understood that the forward end 73 of the nail pack will have a vertical opening 73a therein for passage of the nail strips into the guideway or channel of the magazine. The rear wall 72, however, need not have a notch formed in it, equivalent to notch 39 of FIG. 7, since there will be no pusher element to provide clearance for. Finally, the nail pack 65 will contain some sort of appropriate biasing means to constantly urge nail strips **66*a* through 66*f* toward the partial side wall 74**.

Once the operator has appropriately associated the nail pack 64 with the tool magazine, it is only necessary to advance the first nail strip **66*a* in the direction of arrow A through the nail pack opening 73*a* to the channel or guideway of the magazine and into engagement with the forward pulling or advancing means. This can be accomplished by an appropriate tool or simply by inserting a finger in the space between the magazine and the tool body and into the longitudinal opening of the nail pack 65 defined by nail pack top 70 and the upper edge of side wall 74, and manually shoving the nail strip 66a forwardly. From this point on, feeding of the nail strips is automatic until nail pack 65** is empty.

The forward hook 68 of nail strip **66*a* is not used. It will simply distort out of the way. When the nail strip 66*a* has been advanced to the point where it is nearly removed from nail pack 65, the rearward hook 69 of nail strip 66*a* will engage the forward hook 68 of nail strip 66*b* initiating forward movement of nail strip 66*b*. The nail pack 65 may be provided with an internal cam surface 76, acting in conjunction with the nail strip biasing means (not shown) to cause the strip 66*b* to shift into serial alignment with strip 66*a*. Achieving this alignment will distort the engaged forward and rearward hook elements 68 and 69, but clearances are such as to prevent their disengagement from each other. This procedure will repeat until each of the nail strips 66*b* through 66*f* have been pulled from nail pack 65, the rear hook element of each nail strip engaging the forward hook element of the next nail strip. Obviously, the rear hook element of nail strip 66*f* will not be used, but it will simply distort out of the way as nail strip 66*f*** passes into the channel or guideway of the magazine.

Figure 15:
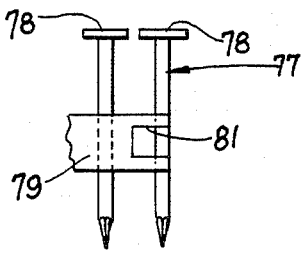
FIG. 15 is a fragmentary elevational view of the forward end of another embodiment of nail strip.
Figure 16:
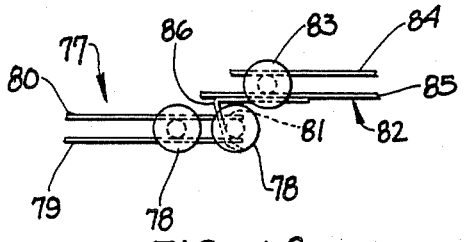
FIG. 16 is a fragmentary plan view of a pair of nail strips of the type shown in FIG. 15 illustrating the engagement of the following strip by the leading strip.
Figure 17:
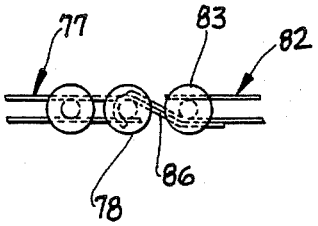
FIG. 17 is a fragmentary plan view of the strips of FIG. 16, illustrating the following strip in substantial alignment with the leading strip.

FIGS. 15, 16, and 17 illustrate yet another embodiment of nail strip for use with a tool having pulling-type nail strip advancement means. In this instance, a strip of nails is shown in FIG. 15. For purposes of an exemplary showing, the nails are illustrated as being vertically oriented, rather than sloped as in FIG. 13. It will be understood that they could be so sloped, if desired. In this instance, the nail strip generally indicated at 77 is made up of a plurality of nails 78 by a pair of tape elements 79 and 80. At the position of the forwardmost nail of nail strip 77, a window or opening 81 is formed in the tapes. It will be understood that each nail strip will have, at its forward end, such a window 81.

FIG. 16 illustrates nail strip 77 together with a preceding nail strip generally indicated at 82 and comprising a plurality of nails 83 joined together by tapes 84 and 85. The rearward end of nail strip 82 is shown in FIG. 16 and is provided with a flexible hook-like element 86. The rearward ends of all of the nail strips will be provided with similar hook-like elements. As is apparent from FIG. 6, as the flexible hook-like element of nail strip 82 reaches the forward end of the next succeeding nail strip 77, the hook-like element 86 will enter through the windows 81 and engage the shank of the first nail of nail strip 77. When the nail strip 77 shifts into alignment with the preceding nail strip 82, the hook-like element 86 will distort in the manner shown in FIG. 17, maintaining its engagement of forwardmost nail 78 of nail strip 77.

Modifications may be made in the invention without departing from the spirit of it.

What is claimed is:

1. A fastener driving tool having a body with a forward portion, a reciprocating driver within said body forward portion, means to actuate said driver, a guide body mounted beneath said body forward portion having a drive track for said driver, an elongated fastener magazine having a forward end affixed to said guide body and having a fastener guiding channel leading to said drive track, and means associated with said tool to urge and advance fasteners within said magazine to said drive track, said magazine comprising first and second sides in parallel spaced relationship connected along their bottom edges to form a U-shaped cross section constituting said fastener guiding channel, said first magazine side having an opening formed therein leading to said channel, said opening extending partway into said tool body, a high-load fastener pack comprising a box-like structure, a plurality of fasteners in said pack, said fasteners being arranged in strips in side-by-side relationship, each strip comprising a tandem row of fasteners and means to temporarily join them together, means to releasably affix said pack to said tool in communication with said opening and said magazine channel, said pack having an opening leading to said magazine channel, and means within said pack to urge said fastener strips laterally toward said magazine.

2. The fastener driving tool claimed in claim 1 wherein said pack comprises a top, a bottom, first and second sides and forward and rearward ends, said pack forward end having a vertical notch therein adjacent said first side and extending from said top to said bottom through which said fastener strips can pass one-at-a-time, said rearward end having a notch therein adjacent said first side and extending from said top to a point approximately at the longitudinal median line of said first side, said first side having a longitudinal slot therein extending from said pack top approximately to said longitudinal median line and from said rearward end notch to said forward end notch, said pack being so sized with respect to said opening as to be partially receivable therein first side foremost with said forward end notch aligned with said magazine channel, said means to urge and advance said fasteners to said drive track comprising a conventional pusher element slidably mounted on said second side of said magazine and spring biased toward said guide body, said pusher element having a feeder shoe member thereon adopted to engage that fastener strip adjacent the first side of said fastener pack and to urge said last mentioned fastener strip from said pack into said channel to said drive track, said notches in said forward and rearward ends of said pack and said slot in said first side of said pack providing clearance for said feeder shoe member.

3. The fastener driving tool claimed in claim 2 wherein said opening in said magazine is provided along its bottom edge and its forward and rearward ends with laterally extending walls comprising a trough to receive and support said fastener pack.

4. The fastener driving tool claimed in claim 2 wherein said fasteners are chosen from the class consisting of nails, staples and blind rivets.

5. The fastener driving tool claimed in claim 2 wherein said fasteners are nails.

6. The fastener driving tool claimed in claim 2 including a magnetic rail affixed to said tool body above said second side of said magazine, said magnetic rail contacting said fastener strip adjacent said first side of said fastener pack to maintain said last mentioned strip in proper alignment with respect to said magazine channel.

7. The fastener driving tool claimed in claim 2 wherein said fasteners are headed nails, said fastener pack bottom being configured to maintain said fastener strip adjacent said pack first side at a level slightly lower than the level of the remainder of the fastener strips so that the heads of the nails of said strip adjacent said pack first side contact the shanks of the nails of the adjacent fastener strip just below their heads, and a cam surface in said tool to urge said fastener strip adjacent said pack first side to said lower position.

8. The fastener driving tool claimed in claim 2 wherein said opening in said magazine and tool body has the configuration of a parallelogram and said fastener pack in side elevation also has the configuration of a parallelogram.

9. The fastener driving tool claimed in claim 2 wherein said opening in said magazine and tool body is retangular and said fastener pack in side elevation is correspondingly rectangular.

10. The fastener driving tool claimed in claim 1 wherein said pack comprises a container member and a cover member, said container member comprising a first side wall, a bottom, forward and rearward ends, and a top extending approximately half way across the upper edges of said forward and rearward ends, said pack top having a free longitudinal edge terminating in an upstanding hook-like structure extending the length of said pack, said pack bottom having a free longitudinal edge terminating in a downwardly extending hook-like structure extending the length of said pack, said cover member having first and second parts, said first part comprising the second side wall of said pack, said second side wall having an upper edge terminating in said second part comprising the remainder of said pack top, said first part of said cover member having a free edge slidably received in said downwardly extending hook-like structure, said second part of said cover member terminating in an upstanding flange slidably received in said upstanding hook-like structure, said magazine having a bottom edge with a longitudinal slot formed therein extending from the rearward end thereof to a point near the forward edge of said opening, said tool body having a flange formed thereon extending from the rearward end thereof above said opening to a point near the forward edge of said opening, said flange defining a longitudinal slot in said body, said upstanding hook-like structure of said fastener pack container member being engagable in said body slot, said downwardly extending hook-like structure being engagable in said magazine slot, said fastener pack container member being slidable along said slots from the rearward end of said tool to said position in communication with said opening simultaneously sliding said cover member off of said container member.

11. The fastener driving tool claimed in claim 10 wherein said fasteners are chosen from the class consisting of nails, staples and blind rivets.

12. The fastener driving tool claimed in claim 10 wherein said fasteners are nails.

13. The fastener driving tool claimed in claim 10 including a magnetic rail affixed to said tool body above said second side of said magazine, said magnetic rail contacting said fastener strip entering said magazine channel from said pack to maintain said last mentioned strip in proper alignment with respect to said magazine channel.

14. The fastener driving tool claimed in claim 3 wherein said fasteners are headed nails, said fastener pack bottom when said container member is affixed to said tool being slightly higher than said magazine channel, cam surface means in said tool to shift that fastener strip entering said magazine channel from said pack container member downwardly so that said heads of said nails of said last mentioned fastener strip contact the shanks of the nails of the adjacent fastener strip just below their heads.

15. The fastener driving tool claimed in claim 10 wherein said opening in said magazine and tool body has the configuration of a parallelogram and said fastener pack in side elevation also has the configuration of a parallelogram.

16. The fastener driving tool claimed in claim 10 wherein said opening in said magazine and tool body is retangular and said fastener pack in side elevation is correspondingly rectangular.

17. The fastener driving tool claimed in claim 10 wherein each fastener strip in said pack has means thereon whereby as it is urged and advanced to said drive track by said urging and advancing means said strip will engage and pull the next adjacent strip along said magazine channel toward, said drive track.

18. The fastener driving tool claimed in claim 17 wherein said fastener strips comprise nails joined together by tape strips extending along the nail shanks on either side thereof in parallel opposed position, said means on each of said fastener strips to engage and pull the next succeeding strip comprises a flexible hook-like structure at the forward end and at the rearward end of each fastener strip, each hook-like structure being affixed to one of said tapes, said hook-like elements being so oriented that the rearward hook-like element of one strip will engage the forward hook-like element of the next succeeding strip to shift said succeeding strip.

19. The fastener driving tool claimed in claim 17 wherein said fastener strips comprise nails joined together by tape strips extending along the nail shanks on either side thereof in parallel opposed position, said means on each of said fastener strips to engage and pull the next succeeding strip comprises a window formed in said tapes adjacent the shank of the forwardmost nail of said strip and a flexible hook-like element affixed to one of said tapes at the rearward end of said strip, said hook-like element being so oriented that the hook-like element of one strip will enter said window of the next succeeding strip and engage the shank of the forwardmost nail thereof to shift said succeeding strip.

20. The fastener driving tool claimed in claim 1, wherein said pack comprises a top, a bottom, first and second sides and forward and rearward ends, said pack forward end having a vertical notch therein adjacent said first side and extending from said top to said bottom through which said fastener strips can pass one-at-a-time, said pack being so sized with respect to said opening as to be partially receivable therein first side foremost with said forward end notch aligned with said magazine channel, each fastener strip having means thereon whereby as it is urged and advanced to said drive track by said urging and advancing means said strip will engage and pull the next adjacent strip from said pack into said magazine channel.

21. The fastener driving tool claimed in claim 20 wherein said fastener strips comprise nails joined together by tape strips extending along the nail shanks on either side thereof in parallel opposed position, said means on each of said fastener strips to engage and pull the next succeeding strip comprises a flexible hook-like structure at the forward end and at the rearward end of each fastener strip, each hook-like structure being affixed to one of said tapes, said hook-like elements being so oriented that the rearward hook-like element of one strip will engage the forward hook-like element of the next succeeding strip to shift said succeeding strip.

22. The fastener driving tool claimed in claim 20 wherein said fastener strips comprise nails joined together by tape strips extending along the nail shanks on either side thereof in parallel opposed position, said means on each of said fastener strips to engage and pull the next succeeding strip comprises a window formed in said tapes adjacent the shank of the forwardmost nail of said strip and a flexible hook-like element affixed to one of said tapes at the rearward end of said strip, said hook-like element being so oriented that the hook-like element of one strip will enter said window of the next succeeding strip and engage the shank of the forwardmost nail thereof to shift said succeeding strip.

23. The fastener driving tool claimed in claim 1 wherein said fasteners are chosen from the class consisting of nails, staples and blind rivets.

24. The fastener driving tool claimed in claim 1 wherein said fasteners are nails.

25. The fastener driving tool claimed in claim 1 wherein said pack is disposable.

26. The fastener driving tool claimed in claim 1 wherein said pack is reusable and refillable.

27. The fastener driving tool claimed in claim 1 wherein said driver actuating means is chosen from the class consisting of pneumatic means, electromechanical means and internal combustion means.

28. The fastener driving tool claimed in claim 1 wherein said pack is disposable.

29. The fastener driving tool claimed in claim 1 wherein said pack is reusable and refillable.

* * * * *